US005803799A

United States Patent [19]

Volodarsky et al.

[11] Patent Number: 5,803,799

[45] Date of Patent: Sep. 8, 1998

[54] WAFER POLISHING HEAD

[75] Inventors: Konstantin Volodarsky, San Francisco; David E. Weldon, Los Gatos, both of Calif.

[73] Assignee: OnTrak Systems, Inc., Fremont, Calif.

[21] Appl. No.: 879,862

[22] Filed: Jun. 20, 1997

Related U.S. Application Data

[63] Continuation of Ser. No. 590,861, Jan. 24, 1996, abandoned.

[51] Int. Cl.[6] ..... B24B 5/00; B24B 29/00

[52] U.S. Cl. ..... 451/288; 451/285; 451/287

[58] Field of Search ..... 451/41, 285, 286, 451/287, 288, 289, 290, 291, 397, 398

[56] References Cited

U.S. PATENT DOCUMENTS

| | | | |
|---|---|---|---|
| 3,579,916 | 5/1971 | Boettcher | 451/288 |
| 3,731,435 | 5/1973 | Boettcher et al. | 451/289 |
| 4,519,168 | 5/1985 | Cesna | 451/390 |
| 5,205,082 | 4/1993 | Shendon et al. . | |
| 5,329,732 | 7/1994 | Karlsrud et al. . | |
| 5,329,734 | 7/1994 | Yu . | |
| 5,377,451 | 1/1995 | Leoni et al. | 451/287 |
| 5,398,459 | 3/1995 | Okumura et al. | 451/286 |
| 5,423,558 | 6/1995 | Koeth et al. | 451/289 |
| 5,423,716 | 6/1995 | Strasbaugh | 451/287 |
| 5,441,444 | 8/1995 | Nakajima | 451/288 |
| 5,449,316 | 9/1995 | Strasbaugh | 451/287 |
| 5,476,414 | 12/1995 | Hirose et al. | 451/288 |
| 5,527,209 | 6/1996 | Volodarsky et al. | 451/388 |
| 5,584,751 | 12/1996 | Kobayashi et al. . | |

FOREIGN PATENT DOCUMENTS

| | | | |
|---|---|---|---|
| 0 747 167 A2 | 12/1996 | European Pat. Off. . | |
| 0 768 148 A1 | 4/1997 | European Pat. Off. . | |
| 55-157473 | 12/1980 | Japan . | |
| 59-187456 | 10/1984 | Japan . | |
| 406091522 | 4/1994 | Japan | 451/288 |

OTHER PUBLICATIONS

E. Worthington, "New CMP Architecture Addresses Key Process Issues", Solid State Technology, Jan. 1996, pp. 61–62.

*Primary Examiner*—Timothy V. Eley
*Assistant Examiner*—Derris H. Banks
*Attorney, Agent, or Firm*—Brinks Hofer Gilson & Lione

[57] ABSTRACT

A polishing head for polishing a semiconductor wafer includes a housing, a wafer carrier movably mounted to the housing, and a wafer retainer movably mounted to the housing. The wafer carrier forms a wafer supporting surface, and the wafer retainer is shaped to retain a wafer in place on the wafer-supporting surface. A first fluid actuator is coupled to the wafer carrier to bias the wafer carrier in a selected direction with respect to the housing, and a second fluid actuator is coupled to the wafer retainer to bias the wafer retainer in a second selected direction with respect to the housing. First and second fluid conduits are coupled to the first and second actuators, respectively, such that fluid pressures in the first and second actuators are separately and independently adjustable with respect to one another. Biasing forces on the retainer can thereby be dynamically adjusted with respect to biasing forces on the carrier during the polishing operation.

13 Claims, 3 Drawing Sheets

WAFER POLISHING HEAD

This application is a continuation of application Ser. No. 08/590,861, filed Jan. 24, 1996 now abandoned.

BACKGROUND OF THE INVENTION

This invention relates to a polishing head for use with a semiconductor wafer polishing machine. Semiconductor wafer polishing machines are well known in the art, and are conventionally used to planarize a semiconductor wafer, which may include one or more photolithographic layers. Such polishing machines typically include one or more polishing heads, each of which supports a respective semiconductor wafer and positions the wafer adjacent a polishing head. The polishing head is moved relative to the polishing pad and a suitable polishing slurry is introduced between the wafer and the pad. U.S. patent application Ser. No. 08/287,658, filed Aug. 9, 1994, and assigned to the assignee of the present invention, discloses one such polishing machine that utilizes a belt type polishing pad. Other polishing machines use rotary polishing pads, and are disclosed for example in U.S. Pat. Nos. 5,329,732 and 5,329,734.

Typically, a polishing head includes a central wafer carrier which is surrounded by a wafer retainer. The wafer carrier and the retainer cooperate to form a wafer-receiving pocket that prevents the wafer from moving laterally with respect to the polishing head during the polishing operation. It has been proposed to mount both the wafer carrier and the wafer retainer for relative movement with respect to the remainder of the polishing head and to bias the carrier and the retainer outwardly, toward the polishing pad. When this is done, both the retainer and the carrier are allowed to float to a limited extent with respect to the polishing head during the polishing operation.

It is of considerable importance that a wafer polishing machine be able to planarize substantially the entire area of the wafer. Difficulties often arise with respect to the marginal edge of the wafer, which can often be polished at a rate different than that of the center of the wafer. If the polishing rate at the margin of the wafer differs excessively from the polishing rate at the center of the wafer, the margin of the wafer may not be suitable for use in standard photolithographic processes. For this reason, it would be highly advantageous if it were possible to adjust the polishing rate at the margin of the wafer with respect to the polishing rate at the center of the wafer in order to achieve improved flatness of the wafer.

SUMMARY OF THE INVENTION

According to one aspect of this invention, a polishing head is provided for a semiconductor wafer. This polishing head comprises a housing, a wafer carrier mounted to the housing and comprising a wafer supporting surface, and a wafer retainer mounted to the housing and shaped to retain a wafer in place on the wafer-supporting surface. At least one of the wafer carrier and the wafer retainer is movably mounted to the housing and means are provided for creating a dynamically adjustable differential biasing force between the wafer carrier and the wafer retainer during a polishing operation.

In the preferred embodiment disclosed below, both the wafer carrier and the wafer retainer are movably mounted with respect to the housing, and each is independently biased toward the polishing pad by a respective fluid actuator. By separately controlling the pressurized fluid introduced into the actuators, the biasing force on the retainer can be selected substantially independently of the biasing force on the wafer itself.

Because the retainer is positioned radially outwardly from the wafer, it is the retainer that contacts the polishing pad before the wafer itself. By suitably adjusting the biasing force on the retainer with respect to the biasing force on the carrier, the retainer can be adjusted so as to condition the polishing pad to achieve optimum polishing of the marginal area of the wafer. For example, by increasing the biasing force on the retainer, the amount of polishing slurry that is introduced to the marginal edge of the wafer between the wafer and the polishing pad can be reduced. By reducing the biasing force on the retainer, the amount of polishing slurry allowed to reach the marginal edge of the wafer can be increased. Similarly, proper adjustment of the biasing force on the retaining ring with respect to the biasing force on the container allows a desired degree of compression to be applied to the polishing pad immediately adjacent to the marginal edge of the wafer.

BRIEF DESCRIPTION OF THE DRAWINGS

In FIG. 1, the polishing head is shown in a polishing position, in which both the semiconductor wafer and the wafer retainer are in contact with a polishing pad.

DETAILED DESCRIPTION OF THE PRESENTLY PREFERRED EMBODIMENTS

Figure 1:
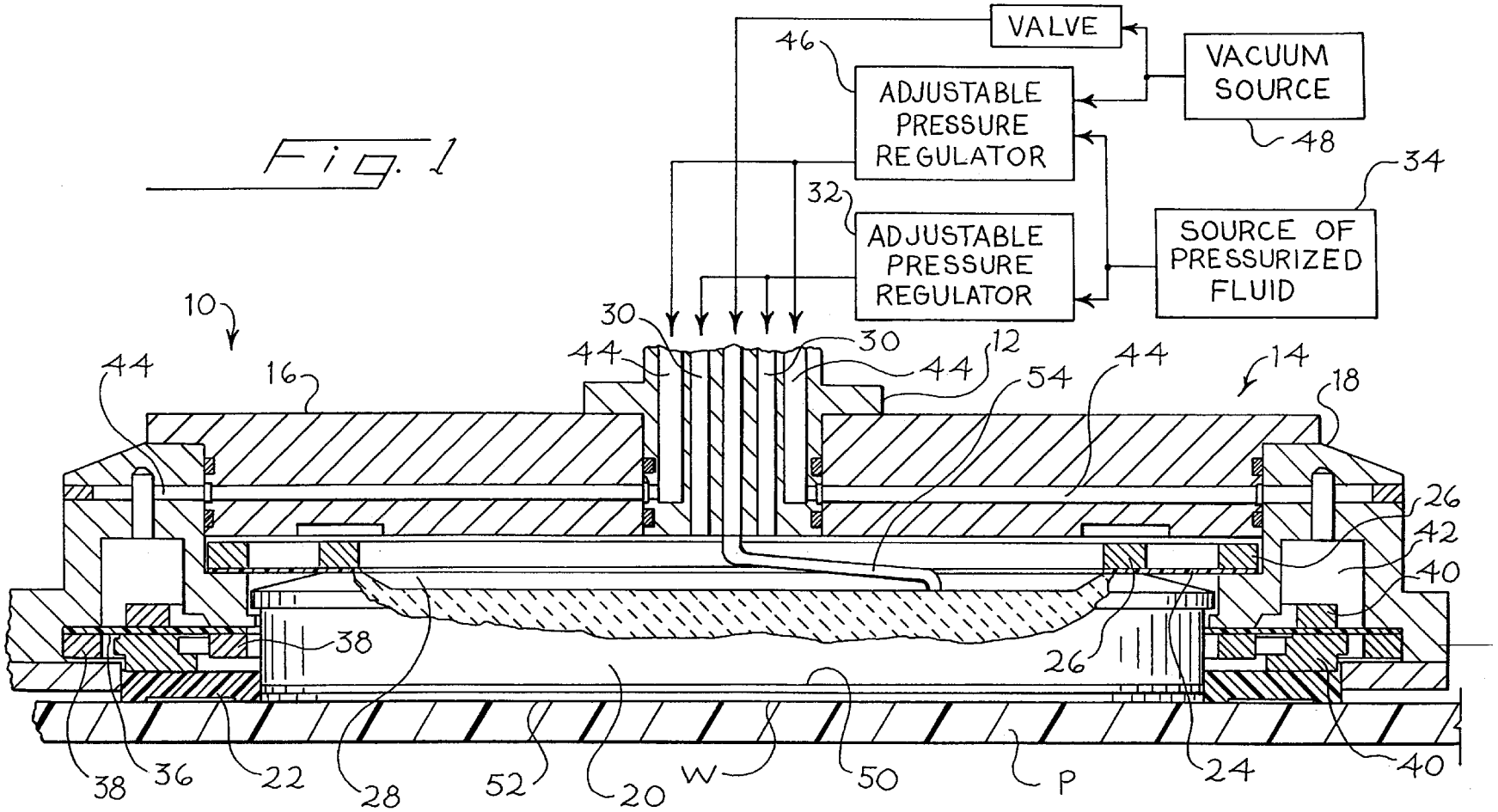
FIG. 1 is a cross-sectional view of a polishing head which incorporates a preferred embodiment of this invention.

Turning now to the drawings, FIG. 1 shows a cross-sectional view of a polishing head 10 which incorporates a presently preferred embodiment of this invention. This polishing head 10 can be mounted to any suitable semiconductor wafer polishing machine, including any of the polishing machines discussed above, as well as others known now or in the future to those skilled in the art. The polishing head 10 includes a spindle 12 which is rigidly secured to a housing 14. The housing 14 is made up of an inner housing 16 and an outer housing 18. The inner housing 16 is rigidly secured to the spindle 12, as for example by bolts (not shown), and the outer housing 18 is rigidly secured to the inner housing 16, as for example by bolts (not shown). The housings 14, 18 can be formed of aluminum or stainless steel.

The polishing head 10 also includes a wafer carrier 20 and a wafer retainer 22. The wafer carrier 20 is circular in shape and is movably mounted with respect to the housing 14 by a first annular diaphragm 24. The carrier can be formed of a ceramic such as alumina 995. The first diaphragm 24 can be formed of a resilient material such as BUNA material and is mechanically secured at its radially inner edge to the wafer carrier 20 and at its radially outer edge to the outer housing 18 by mounting rings 26. The housing 14, the wafer carrier 20 and the first diaphragm 24 cooperate to form a first fluid chamber 28 which is connected by a first fluid conduit 30 to a first adjustable pressure regulator 32. The first adjustable pressure regulator 32 is in turn connected to a source of pressurized fluid 34.

The wafer retainer 22 is annular in shape, and movably mounted to the housing 14 by a second diaphragm 36, which is also annular in shape. The retainer 22 can be made for example of DELRIN AF®. The inner and outer marginal edges of the second diaphragm are secured to the outer housing 18 by mounting rings 38, and the central portion of the second diaphragm is secured to the wafer retainer 22 by mounting rings 40. The second diaphragm 36 and the housing 14 cooperate to form a second fluid chamber 42 that is bounded in part by the second diaphragm 36. This second fluid chamber 42 is connected by a second fluid conduit 44 to a second adjustable pressure regulator 46. The second adjustable pressure regulator 46 is connected both the source pressurized fluid 34 and to a vacuum source 48.

The wafer carrier defines a wafer-supporting surface 50 which in the conventional manner supports an insert 52. A vacuum conduit 54 is conducted between the vacuum source 48 and the wafer carrier 20. The vacuum source 48 can be used to create a low pressure suction tending to hold a wafer W in place on the insert 52. When the wafer W is positioned on the insert 52, the wafer retainer 22 substantially surrounds the wafer W to prevent undesired lateral movement between the wafer W and the polishing head 10.

The first fluid chamber 28, the first fluid conduit 30 and the first diaphragm 24 cooperate with the wafer carrier 20 to form a first fluid actuator. The first adjustable pressure regulator 32 can be used to adjust the pressure of a fluid such as air in the first fluid chamber 28 in order to provide a dynamically adjustable biasing force tending to press the wafer W against the polishing pad P of the polishing machine. This first fluid actuator provides an evenly distributed force across substantially the entire upper surface of the wafer carrier 20, thereby minimizing uneven forces that might tend to distort the wafer carrier 20. The first diaphragm 24 performs both a mounting function in that it allows differential movement between the carrier 20 and the housing 14, and a sealing function in that it seals pressurized fluid in the first fluid chamber 28.

The second diaphragm 36, the second fluid chamber 42 and the second fluid conduit 44 cooperate to form a second fluid actuator which can be used to adjust a biasing force tending to urge the wafer retainer 22 outwardly, toward the polishing pad P. The second fluid actuator is annular in shape and thereby applies evenly distributed biasing forces to the wafer retainer 22. The second diaphragm 36 performs two separate functions: movably mounting the wafer retainer 22 with respect to the housing 14, and sealing the second fluid chamber 42.

Because the first fluid chamber 28, the first fluid conduit 30 and the first adjustable pressure regulator 32 are isolated from and independent of the second fluid chamber 42, the second fluid conduit 44 and the second adjustable pressure regulator 46, the biasing forces on the wafer carrier 20 can be adjusted in a dynamic fashion during the wafer polishing operation with respect to the biasing forces on the wafer retainer 22. In this way, conditioning forces applied by the wafer retainer 22 to the polishing pad P and the flow of polishing slurry onto the marginal edges of the wafer W can be adjusted in real time during the polishing operation.

The first and second adjustable pressure regulators 32, 46 operate as independently controllable valves. Of course, the widest variety of approaches can be used for the regulators 32, 46, including both manually controlled and computer controlled regulators. Other suitable means for adjusting fluid pressure may be substituted.

FIG. 1 shows the polishing head 10 in a use position, in which both the wafer W and the wafer retainer 22 are biased away from the housing 14, into contact with the polishing pad P. Note that in the polishing position both the wafer carrier 20 and the wafer retainer 22 are free to float over a limited range of movement, suspended by the respective diaphragms 24, 36.

Figure 2:
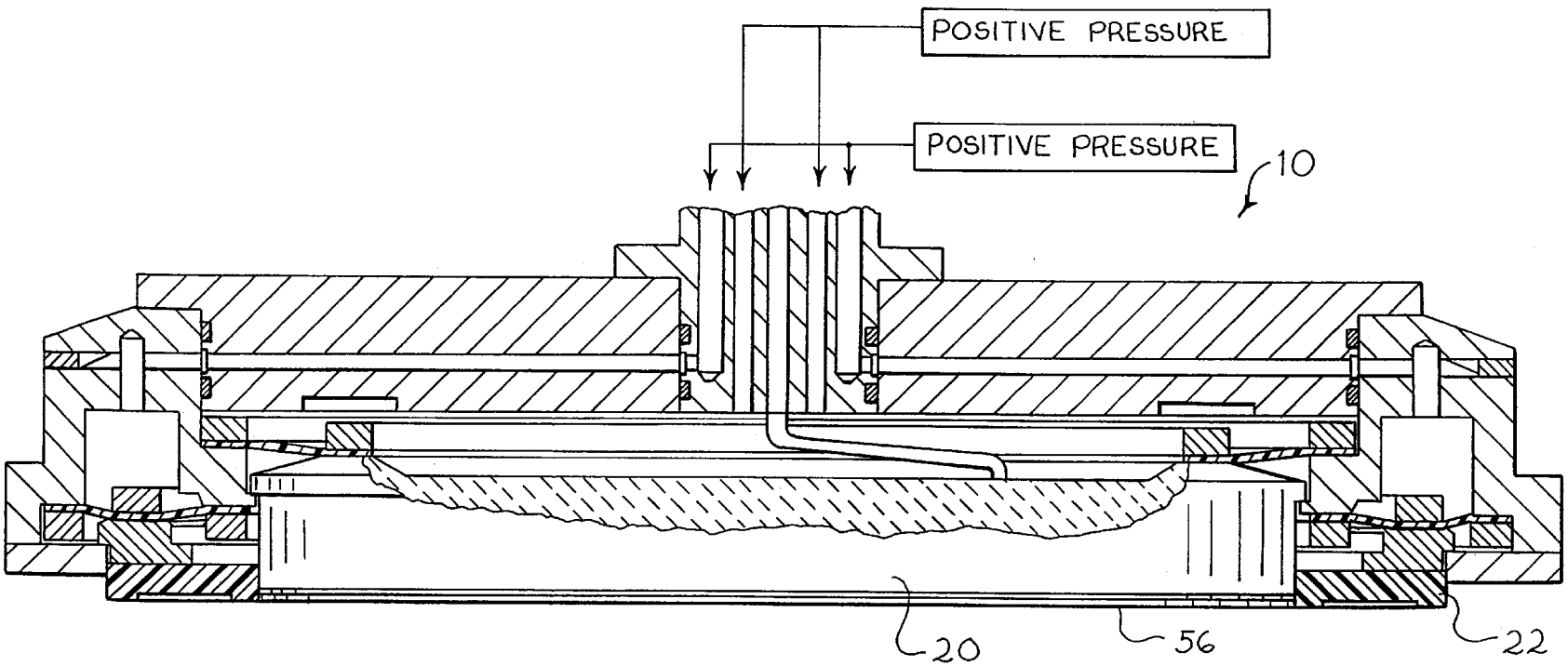
FIG. 2 is a cross-sectional view of the polishing head of FIG. 1 showing the wafer carrier and the wafer retainer in a loading position, ready for wafer loading.

FIG. 2 shows the polishing head 10 in a wafer loading position. In this position, the polishing head 10 has been moved away from the polishing pad and the pressurized fluids in the first and second fluid chambers 28, 42 bias the wafer carrier 20 and the wafer retainer 22 to extreme outer positions. In these positions, the wafer carrier 20 and the wafer retainer 22 form a wafer receiving pocket 56.

Figure 3:
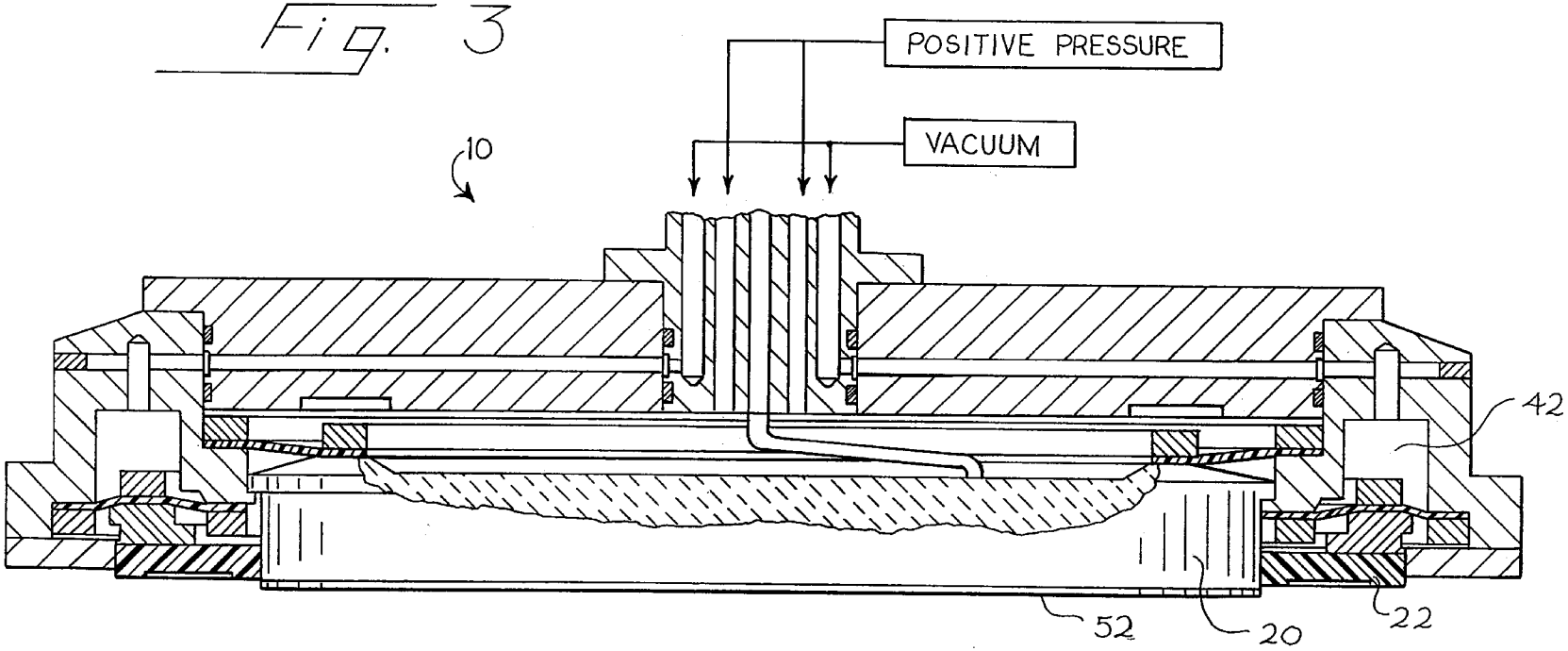
FIG. 3 is a cross-sectional view of the polishing head of FIG. 1 showing the wafer carrier and the wafer retainer positioned in an insert replacement position.

FIG. 3 shows the polishing head 10 in an insert-replacement position. In this position, the wafer carrier 20 is in the same position as in FIG. 2. However, the second adjustable pressure regulator 46 (FIG. 1) has been used to apply a vacuum to the second fluid chamber 42 so as to move the wafer retainer 22 toward the housing 14. This moves the wafer retainer 22 inwardly of the wafer carrier 20, thereby exposing the insert 52 for ready removal and replacement.

The polishing head 10 can be used in a wafer polishing operation by first mounting the wafer W on the wafer carrier 20 as shown in FIG. 1. The wafer can either be a bare substrate (without photo-lithographic layers) or a substrate bearing one or more photolitographic layers. The polishing head 10 is then brought adjacent to the polishing pad P and relative movement is provided between the polishing head 10 and the polishing pad P. This relative movement can be any desired combination of linear and rotary motions. The adjustable pressure regulators 32, 46 are then used to bias the wafer carrier and therefore the wafer W against the polishing pad P and the retainer 22 against the polishing pad P. By independently adjusting the regulators 32, 46, the relative biasing force on the wafer retainer 22 can be varied (either increased or decreased) with respect to the biasing force on the wafer carrier 20. In this way, the degree to which the polishing pad P is compressed before it contacts the wafer W can be adjusted, as can the rate at which polishing slurry is admitted to the marginal edge of the wafer W.

The first and second fluid actuators described above operate as a means for creating a dynamically adjustable differential biasing force between the carrier 20 and the retainer 22. It should be recognized that other means can be used for dynamically adjusting the differential biasing force between these two elements. For example, the entire polishing head 10 can be biased toward the polishing pad P and then either the carrier 20 or the retainer 22 can be movably mounted with respect the polishing head 10 and independently biased toward the pad P. When this approach is used, either the carrier 20 or the retainer 22 can be rigidly mounted with respect to the housing 14.

Additionally, other sealing approaches can be used in substitution for the diaphragms 24, 36. For example, a single diaphragm can be provided which supports both the carrier 20 and the retainer 22. Alternately, bellows or pistons with sliding seals can be substituted for the diaphragms disclosed above. The diaphragms shown in the drawings are preferred, because they minimize friction between the moving elements and the housing, while providing an excellent seal.

Additionally, this invention can be implemented with other types of actuators. Fluid actuators using a pressurized liquid can be substituted for the fluid actuators discussed above, which preferably use pressurized gas such as air. Furthermore, in some embodiments the fluid actuators can be replaced with actuators such as mechanical springs having a means for adjusting the spring force provided by the mechanical spring.

Finally, as pointed out above, the polishing head of this invention can be adapted for use with a wide variety of semiconductor wafer polishing machines, including machines with polishing pads having both linear and rotary movements.

It is therefore intended that the foregoing detailed description be regarded as illustrative rather than limiting. It is the claims, including all equivalence, which are intended to define the scope of this invention.

We claim:

1. A polishing head for polishing a semiconductor wafer, said polishing head comprising:

a housing;

a wafer carrier mounted to the housing, said wafer carrier comprising a wafer-supporting surface;

a wafer retainer mounted to the housing, said wafer retainer shaped to retain a wafer in place on the wafer-supporting surface;

at least one of the wafer carrier and the wafer retainer movably mounted to the housing;

means for adjusting a biasing force on the wafer retainer independently of biasing force on the wafer carrier during a wafer polishing operation.

2. A polishing head for polishing a semiconductor wafer, said polishing head comprising:

a housing;

a wafer carrier mounted to the housing, said wafer carrier comprising a wafer-supporting surface;

a wafer retainer mounted to the housing, said wafer retainer shaped to retain a wafer in place on the wafer-supporting surface;

at least one of the wafer carrier and the wafer retainer movably mounted to the housing;

a fluid actuator coupled to said at least one of the wafer carrier and the wafer retainer to selectively apply a biasing force only to said at least one of the wafer carrier and the wafer retainer, thereby dynamically adjusting relative biasing forces on the wafer carrier and the wafer retainer.

3. A polishing head for polishing a semiconductor wafer, said polishing head comprising:

a housing;

a wafer carrier movably mounted to the housing, said wafer carrier comprising a wafer-supporting surface;

a wafer retainer movably mounted to the housing, said wafer retainer shaped to retain a wafer in place on the wafer-supporting surface;

a first fluid actuator coupled to the wafer carrier to bias the wafer carrier in a first selected direction with respect to the housing;

a second fluid actuator coupled to the wafer retainer to bias the wafer retainer in a second selected direction with respect to the housing;

first and second fluid conduits coupled to the first and second actuators, respectively, such that fluid pressure in the first actuator is adjustable with respect to fluid pressure in the second actuator.

4. The invention of claim 3 further comprising a spindle secured to the housing, wherein the first and second fluid conduits extend into the spindle.

5. The invention of claim 4 further comprising first and second valves coupled to the first and second fluid conduits, respectively, said first and second valves being independently controllable.

6. The invention of claim 3 wherein the wafer carrier is mounted to the housing by a first diaphragm, and wherein the wafer retainer is mounted to the housing by a second diaphragm.

7. The invention of claim 6 wherein the first and second fluid actuators comprise respective first and second fluid chambers coupled to the first and second fluid conduits, respectively, said first fluid chamber bounded in part by the first diaphragm, and said second fluid chamber bounded in part by the second diaphragm.

8. The invention of claim 7 wherein the first fluid chamber is circular in shape, and wherein the second fluid chamber is annular in shape.

9. The invention of claim 8 wherein the wafer retainer is annular in shape.

10. The invention of claim 3 wherein the first and second directions are aligned with one another.

11. A method for controlling polishing of a semiconductor wafer, said method comprising the following steps:

a) mounting a semiconductor wafer on a wafer carrier of a polishing head, said wafer surrounded at least in part by a wafer retainer;

b) biasing the wafer against a polishing pad with a wafer biasing force;

c) biasing the wafer retainer against the polishing pad with a retainer biasing force; and d) adjusting the retainer biasing force with respect to the wafer biasing force.

12. The method of claim 11 wherein step (b) comprises the step of providing a first pressurized fluid to the polishing head, wherein step (c) comprises the step of providing a second pressurized fluid to the polishing head, and wherein step (d) comprises the step of adjusting pressure of the second pressurized fluid with respect to pressure of the first pressurized fluid.

13. The method of claim 11 wherein step (d) is accomplished during a wafer polishing operation.

* * * * *